US008267751B2

(12) United States Patent
Sunderland

(10) Patent No.: US 8,267,751 B2
(45) Date of Patent: Sep. 18, 2012

(54) CHAMFERING TOOL AND METHOD

(75) Inventor: Nita K Sunderland, Washington, IL (US)

(73) Assignee: Sunderland Tool, Ltd., Washington, IL (US)

( * ) Notice: Subject to any disclaimer, the term of this patent is extended or adjusted under 35 U.S.C. 154(b) by 988 days.

(21) Appl. No.: 11/719,141

(22) PCT Filed: Nov. 10, 2005

(86) PCT No.: PCT/US2005/040766

§ 371 (c)(1),
(2), (4) Date: Oct. 29, 2008

(87) PCT Pub. No.: WO2006/053138

PCT Pub. Date: May 18, 2006

(65) Prior Publication Data

US 2009/0061749 A1 Mar. 5, 2009

Related U.S. Application Data

(60) Provisional application No. 60/627,219, filed on Nov. 12, 2004, provisional application No. 60/653,450, filed on Feb. 16, 2005, provisional application No. 60/667,713, filed on Apr. 1, 2005.

(51) Int. Cl.
*B24B 23/00* (2006.01)

(52) U.S. Cl. ..... 451/410; 451/344; 451/359; 451/365; 451/415; 451/438; 451/549

(58) Field of Classification Search ..... 451/344, 451/359, 365, 369, 406, 410, 415, 438, 549
See application file for complete search history.

(56) References Cited

U.S. PATENT DOCUMENTS

| | | | | |
|---|---|---|---|---|
| 610,226 | A | 9/1898 | Carr | |
| 1,202,400 | A | 10/1916 | McCullough | |
| 2,209,228 | A | 7/1940 | Judge | |
| 3,828,484 | A * | 8/1974 | Baechle | 451/355 |
| 4,862,645 | A | 9/1989 | Takigawa et al. | |
| 6,450,741 | B1 * | 9/2002 | Cannelli, Jr. | 409/138 |
| 6,592,440 | B2 * | 7/2003 | Mueller | 451/355 |
| 6,702,656 | B1 * | 3/2004 | Hibbert | 451/120 |

(Continued)

OTHER PUBLICATIONS

PCT International Search Report for PCT/US05/40766.

(Continued)

*Primary Examiner* — Eileen P. Morgan
(74) *Attorney, Agent, or Firm* — Robert C. Haldiman; Husch Blackwell LLP

(57) ABSTRACT

A chamfering tool adapted to mount on a handheld grinder, the grinder having a guard and the grinder having a grinding face. The chamfering tool includes a fixed mount, to be attached to the guard on the handheld grinder. A moveable mount is attached to the fixed mount. A first guide face is attached to the fixed mount and a second guide face is attached to the moveable mount. The guide face defines a space there between. The space being disposed such that the grinding face of the handheld grinder contacts a work piece held against at least one of the first guide face or the second guide face. An adjustment member is fixed to one of the fixed mount or the moveable mount. The adjustment member hold the moveable guide mount in a user selected position. The adjustment member are adjustable to selectively vary a width of the space between the first guide face and the second guide face.

15 Claims, 16 Drawing Sheets

U.S. PATENT DOCUMENTS

| | | | | |
|---|---|---|---|---|
| 6,761,623 | B1 * | 7/2004 | Baker | 451/280 |
| 7,165,920 | B2 * | 1/2007 | Baber | 409/182 |
| 7,281,969 | B2 * | 10/2007 | Naples et al. | 451/371 |
| 2001/0036802 | A1 * | 11/2001 | Mueller | 451/355 |
| 2003/0224707 | A1 * | 12/2003 | Segiel, Jr. | 451/451 |
| 2004/0053565 | A1 * | 3/2004 | Hibbert | 451/120 |
| 2006/0258271 | A1 * | 11/2006 | Naples et al. | 451/45 |

OTHER PUBLICATIONS

Supplementary European Search Report, App. No. EP 05 81 8952 (Nov. 9, 2009).

* cited by examiner

CHAMFERING TOOL AND METHOD

CROSS-REFERENCE TO RELATED APPLICATIONS

This application claims the benefit of U.S. Provisional Application Nos. 60/627,219 filed Nov. 12, 2004; 60/653,450 filed Feb. 16, 2005; and 60/667,713 filed Apr. 1, 2005. This application claims the benefit of PCT Application No. US2005/040766 filed Nov. 10, 2005.

BACKGROUND OF THE INVENTION

1. Field of the Invention

The present invention is in the field of chamfering, beveling and finishing stone facing and other building materials, particularly with a hand tool.

2. Related Art

Millions of square yards of facing material are currently installed in buildings throughout the world. Marble, granite and sometimes synthetic composite materials are currently mounted both on the inside and outside of buildings in order that they may present an aesthetically pleasing surface of the building. The facing material is installed and mounted in sections. The sections have seams between them and, at the corner of the building, the edges of the facing materials on the adjacent walls will be finished, in most cases, usually with a bevel or chamfer. The bevel is usually at an angle to the main surface of the facing material.

During initial installation facing materials, large slabs of granite, marble or composite material are received from a mill, or supplier, and mounted in place with fasteners. The bevels along the edges of the facing are traditionally created at the mill. Because the slabs are typically large and heavy, the bevel is usually created with a large piece of equipment, typically mounted on a table. U.S. Pat. No. 4,862,645 to Takigawa et al. illustrates an example of such equipment.

Like any material, marble and granite are subject to wear and tear. Along the edges, chipping becomes a problem through years of use. Accordingly, workmen are periodically required to refinish installed materials, particularly the edges and beveling of facing slabs, which tend to become chipped.

While a great many of grinding tools are available in the market place, they currently must be hand guided. For stone and composite material, chamfering and beveling equipment having adequate guides for a more precise chamfering are currently only available on large, heavy fixed table mounted tools. There is a need in the art for a hand held chamfering tool with guides to promote a consistent and precise bevel for work on facing materials installed in situ.

SUMMARY OF THE INVENTION

It is in view of the above problems that the present invention was developed.

The invention is a chamfering guide tool for grinding material, such as stone. More particularly, it is a guide assembly for installation on and use with a handheld grinding tool. Most particularly, the handheld stone chamfering guide is designed for chamfering or beveling the edges of stone on sight, whether previously mounted or not.

Further features and advantages of the present invention, as well as the structure and operation of various embodiments of the present invention, are described in detail below with reference to the accompanying drawings.

BRIEF DESCRIPTION OF THE DRAWINGS

The accompanying drawings, which are incorporated in and form a part of the specification, illustrate the embodiments of the present invention and together with the description, serve to explain the principles of the invention. In the drawings.

DETAILED DESCRIPTION OF THE PREFERRED EMBODIMENTS

Figure 1:
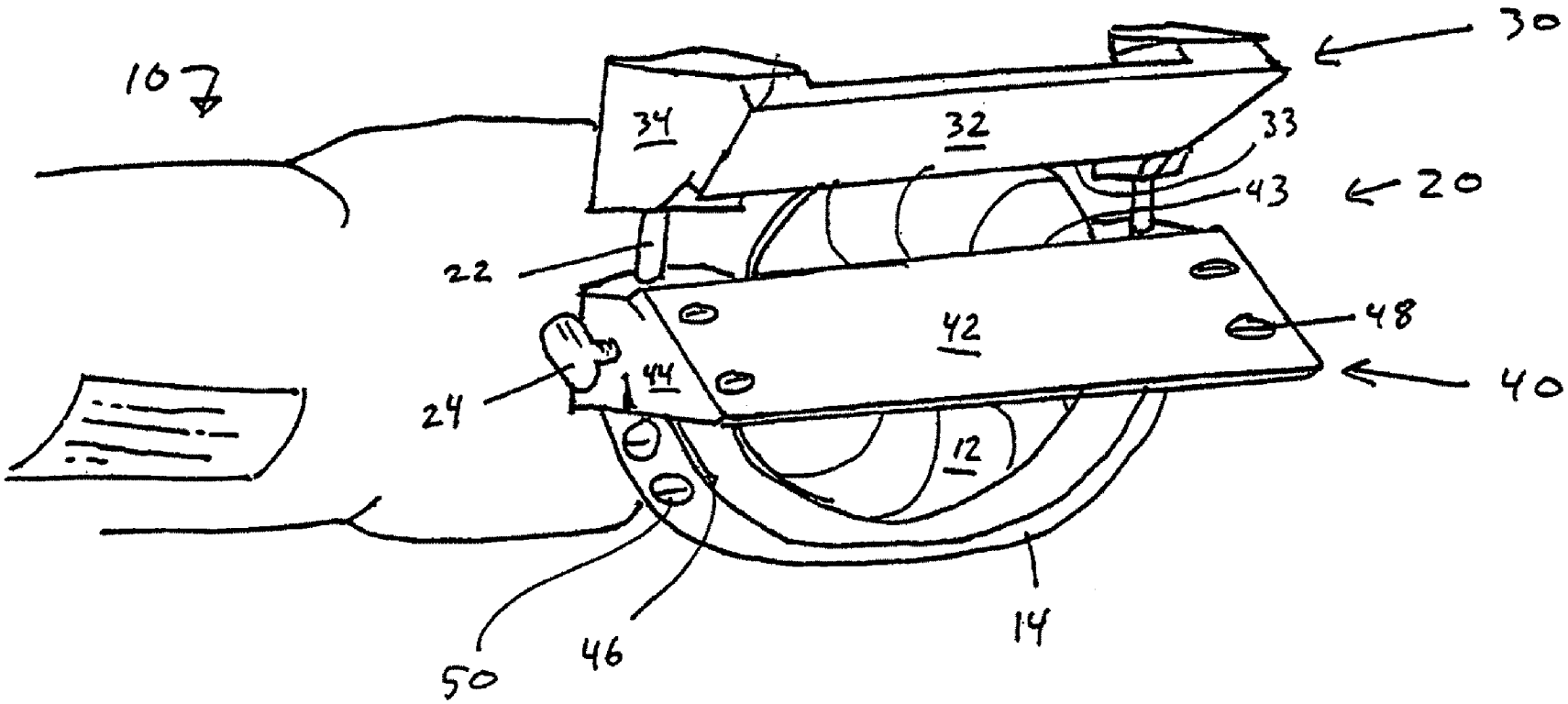
FIG. 1 is a perspective view of a handheld grinding tool with the chamfering guides in place.

Referring to the accompanying drawings in which like reference numbers indicate like elements, the chamfering guide assembly 20 is adapted for mounting on any of a variety of conventional handheld grinding (or buffing or polishing) tools 10. As an example, the handheld grinding tool 10 may be a motorized angle grinder. Such tools as are adaptable for use with the chamfering guide assembly 20 are characterized by a rotating disk 12 having an abrasive surface which performs the actual grinding of the material being finished. For example, the rotating disk 12 may be a flat, masonry grinding wheel. Rotating disks 12 come in standard sizes and typically range from 4 inches to 10 inches (100 mm to 250 mm) in diameter. The present invention is adapted to augment work with any handheld grinder having such an abrasive surface. Most of these tools also have a partial housing 14, sometimes referred to as a guard or safety shield, already installed on them. In the depicted embodiment, as is typical, the rotating disk 12 is circular, and accordingly the partial housing 14 is also semi-circular.

The chamfering guide assembly 20 is comprised of a fixed portion 40 and a moveable portion 30. The fixed and moveable portions 30, 40 are adjoined by adjustment members 22 which are fixed permanently to one of the guide portions 30 or 40. In the depicted embodiment, the adjustment members 22 is a pair of rods. The other of the guide portions 30 or 40 will have holes (not shown) aligned to receive and dimensioned to closely cooperate with the adjustment members 22 such that the moveable portion, which in the depicted embodiment is portion 30, may move closer to and farther away from the fixed portion 40. Once a desired distance has been selected, a locking screw 24 is tightened to hold the adjustment members 22 in place.

Each guide portion 30, 40 has a guide face 32 and 42, respectively. These faces 32, 42 are smooth, and accordingly any fixture of them to the base elements 34 and 44 must also present a smooth face to the work piece. In the depicted embodiment, upper guide face 32 is welded to a base mount 34 of moveable guide portion 30. In the lower depicted guide portion 40, the guide face 42 is welded to a base mount 44 but also secured by screws 48, which are counter sunk. However, those skilled in the art would understand that either portion 30, 40 could be comprised of a single casting, a weldment comprising multiple components, or an assembly of components fastened together.

Guide faces 32 and 42 will be in contact with and slide along the actual surface or surfaces of the granite, marble or other material being chamfered or beveled. Accordingly, the smooth face structure of the chamfering guide assembly 20 allows for the grinding tool 10 to slide along the face of the stone, which is usually polished, without scratching or otherwise defacing it.

The design of the chamfering guide assembly 20 of the present invention also maintains a clear area between guide faces 32 and 42 which area will be occupied by the work piece when the unit is in use. This gap is defined between the inside edges 33 and 43 respectively of the guide faces 32 and 42. In the depicted embodiment, the gap is adjustable from about 0.125 inch (3 mm) to about 1 inch (25 mm).

At least the guide faces 32 and 42, if not also the base mounts 34 and 44 are preferably made of stainless steel. Alternatively, they may be made of brass, bronze, or a non-metallic material, such as plastic material. Stainless steel would be preferred, since softer materials tend to occasionally spoil polished stone surfaces by leaving visible smudges.

As is apparent in the figures, the chamfering guide faces 32 and 42 form an angle between them. In the embodiment depicted in FIGS. 1-3, this angle is 90°, however, those skilled in the art would understand that angles other than 90° may be used. An angle of 90° is useful for the vast majority of single facing slabs, accommodating thereby the conventional rectangular shape of a polished facing surface and its usual 45° edge. It is also useful for a corner joinder of two slabs. In either case, the grinding surface 12 is disposed between the guide faces 32 and 42 and, where the guide faces are flush against the rectangular surfaces of the facing slab, the grinding face 12 is properly angled and disposed to create a chamfer or bevel along the edge of the slab at the preferred angle, which in most cases, as depicted, is 45°.

The depth of the chamfer or bevel is adjusted by loosening the screw 24 and sliding the moveable portion 30 towards or away from the fixed portion 40, thereby adjusting the width between an inner surface of guide faces 32 and 42. As the gap between the inner surfaces 33, 43 of guide faces 32, 42 widens, the grinding face 12 is exposed to the work piece to the greater depth, and a deeper bevel or chamfer is made possible.

Because the tool is handheld, it is preferred that the surface areas of chamfering guide faces 32, 42 have a surface area large enough to afford stable contact of the overall tool with the work piece during grinding. While stable contact is important, other considerations include the area in which a worker has to work, the diameter of the rotating disk 12, and the size and weight of the grinding tool 10. For example, if the work area is a confined space, smaller guide faces 32, 42 may be required. In contrast, if the grinding tool 10 is quite large, larger guide faces 32, 42 may be required to support the weight of the grinding tool 10. As such, the guide faces may be sized according to the above factors. The lower guide face 42 has a width of from about ¾ inch (19 mm) to about 3 inches (75 mm) and a length of from about 3 inches (75 mm) to about 12 inches (305 mm). The upper guide face 32 has a width of from about ⅜ inch (10 mm) to about 3 inches (75 mm) and a length of from about 3 inches (75 mm) to about 12 inches (305 mm). In the depicted embodiment of the invention, when mounted on a typical hand grinding tool with a 5 inch (125 mm) diameter grinding disk in place, the dimensions of the lower chamfering guide face 42 are 1.5 inches (37 mm) by 5 inches (150 mm) and the dimensions of the upper or moveable guide surface 32 are ½ inch (12 mm) by 5 inches (150 mm).

Figure 2:
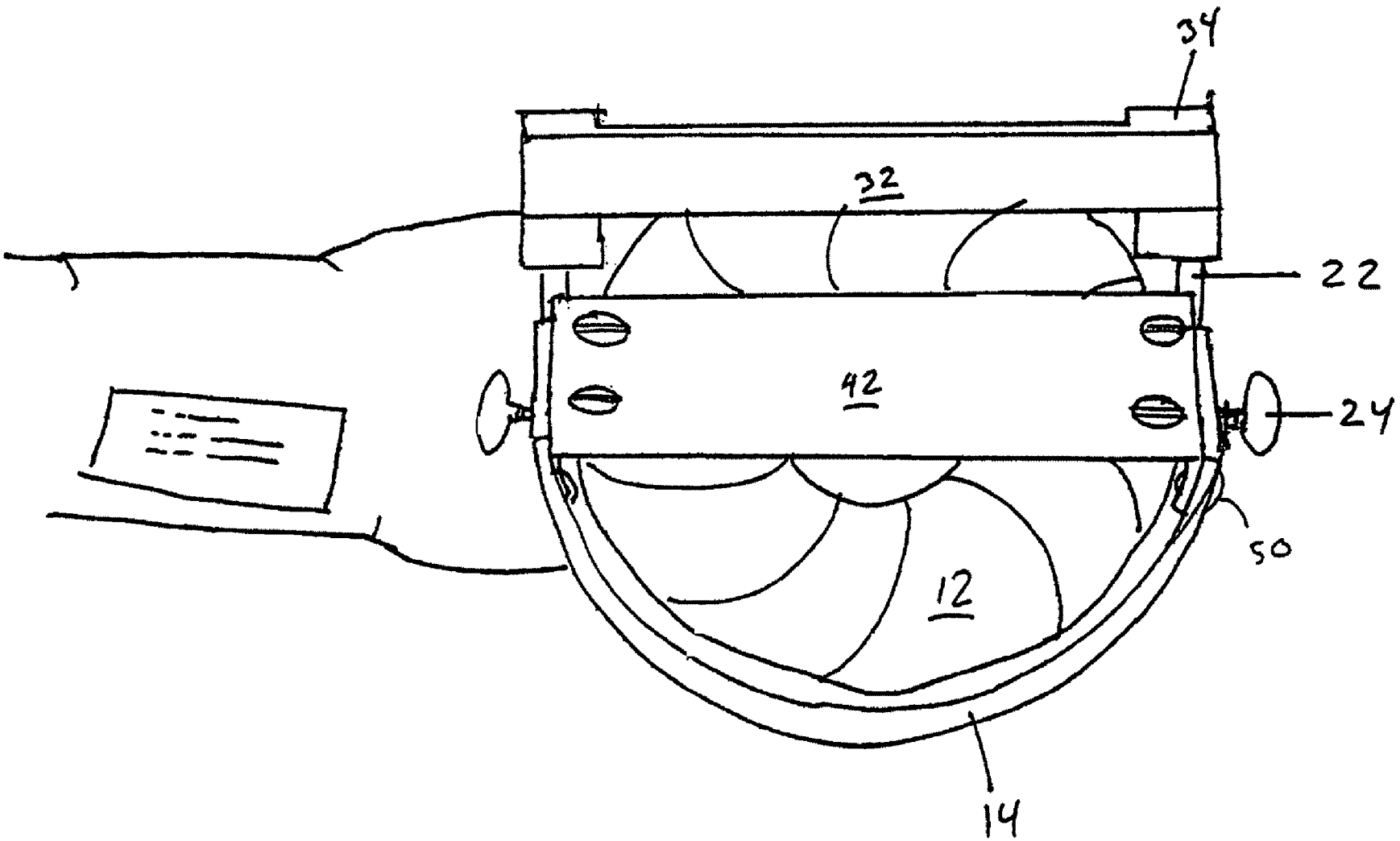
FIG. 2 is a side view of a handheld grinding tool with the chamfering guides in place.
Figure 3:
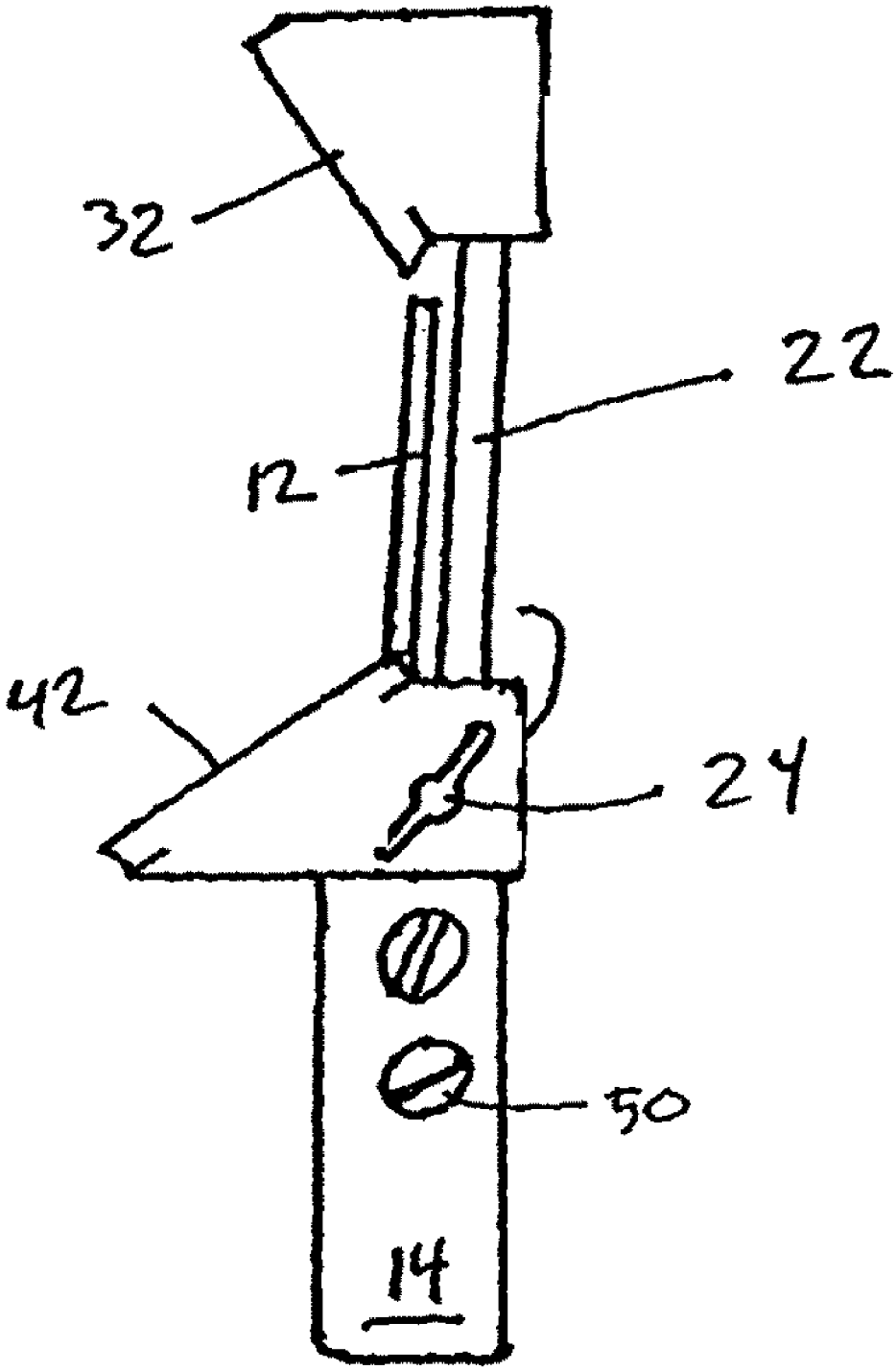
FIG. 3 is an end view of handheld grinding tool with the chamfering guides in place.

The first embodiment depicted in FIGS. 1-3 adjusts a distance between guide faces 32 and 42. The distance defines a space between the guide faces, and this space is disposed such that the grinding face 12 of the handheld grinding tool 10 is positioned to contact the work piece. Adjustment member 22 moves toward and away from the fixed mount 44 in order to vary the width of the space defined between the edges 33 and 43 of the guide faces 32 and 42. By selectively varying the width of the space between the guide faces, the depth to which the grinding face 12 of the hand grinder may grind the work pieces is defined. It will be observed by those with skill in the art, however, that the adjustment member 22 the adjustment member receiver in the fixed mounting block 44 do not vary the angle between guide faces 32 and 42.

Figure 4:
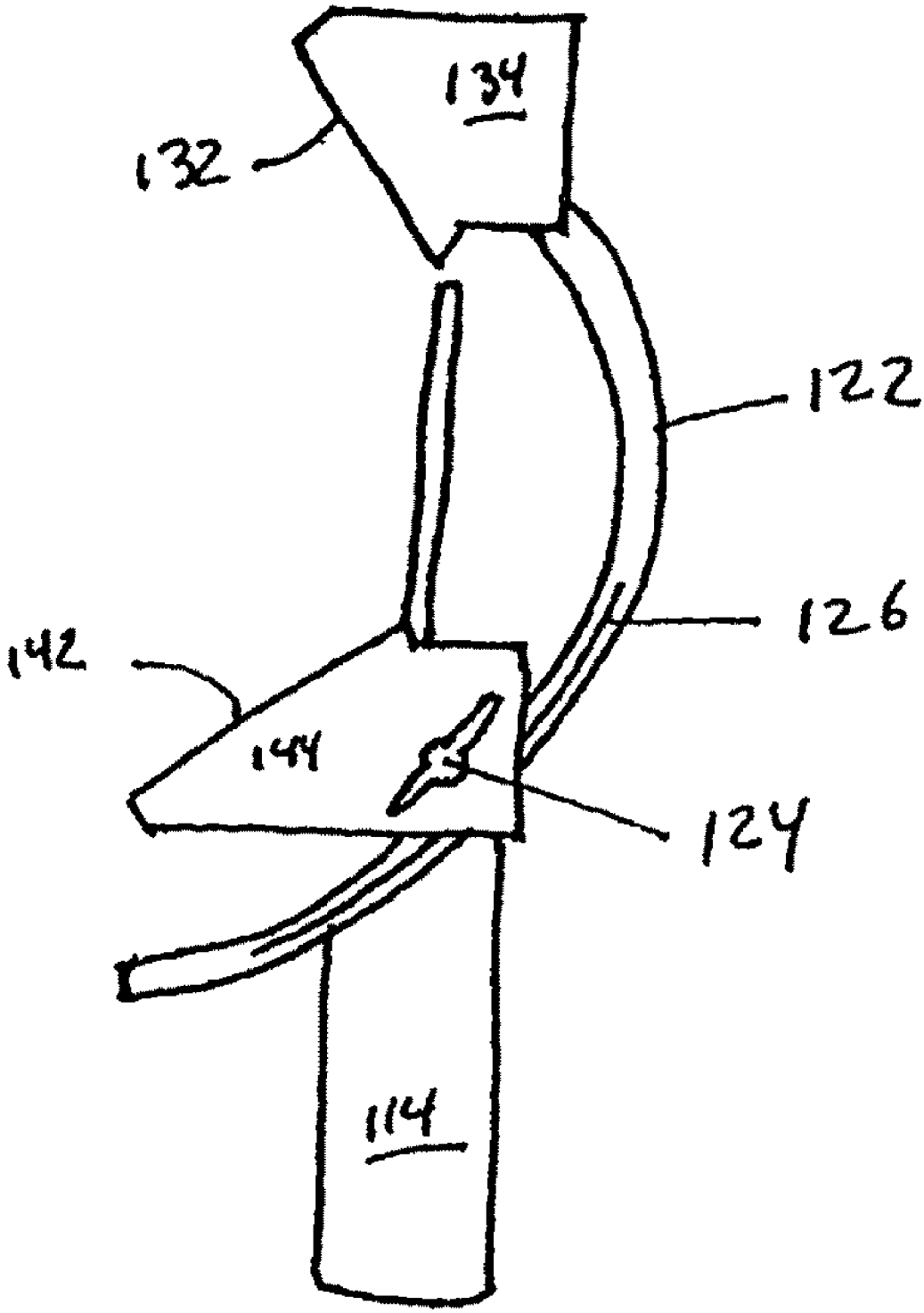
FIG. 4 is an end view of an alternative embodiment.

FIG. 4 depicts an alternative embodiment by which an angle between guide faces 132, 142 may be varied. In FIG. 4 adjustment member 122 is curved. It remains fixedly attached to a moveable mount 134. There is still a through hole in fixed mount 144, the through hole being an adjustment member receiver. However, the through hole is also angled and curved to receive the curves adjustment member 122. In FIG. 4, the adjustment member 122 is still a slide. FIG. 4 also depicts a variation and may be applied to any embodiment; the slide 122 includes a key 126, said key being dimensioned and disposed to interact with the corresponding key in the adjustment member receiver, the hole in the fixed mount 144. By loosening the lock screw 124, the slide is released to slide through the throughhole. In so doing, the angle between the guide faces 132 and 142 is altered. Accordingly, work pieces that have been fabricated or that are to be fabricated or mounted at some angle other than 90° may be ground, chamfered or beveled more efficiently by using the hand grinding tool with the chamfering guide assembly mounted on it.

To assemble the chamfering guide assembly 20 with the grinding tool 10, mounting bolts 50 are simply placed through holes (not shown) in the partial housing 14. In some applications, the holes must be drilled prior to assembly. The bolts 50 also insert through corresponding holes in mounting brackets 46 which are fixedly attached to the base mount 44. Bolts 50 are tightened to corresponding nuts (not shown) and the unit is mounted. The user loosens lock bolts 24, inserts and adjusts the adjustment members 22, which in the depicted embodiment is a slide, to define the width of the space between the mounting faces 32 and 42 thereby correspondingly defining the depth to which a bevel or chamfer will be ground in the work piece. A steel rule may be used to verify that the adjustment members 22 have an equal amount of adjustment.

In operation, the adjustment of the space defined between the edges 33 and 43 of the guide faces 32 and 42 may be readjusted as the worker sees fit. One or the other of the guide faces 32 and 42 are placed against the first face of the work piece. If deep grinding or chamfering is to be done, the first of the contact faces may be maintained the work piece during grinding until the second of the guide faces comes in contact with the second face of the work piece. If grinding is not deep, if rough areas are to be smoothed or broken, chipped or cracked pieces are to be smoothed or if the work piece has already been partially ground, both a first and second face of the work piece may be brought into contact with both of the guide faces as grinding begins. In either case, the entire chamfering guide assembly and hand grinder can be moved along the edge of the work piece by the worker in order that the grinding face may be maintained at the selected depth (and in the case of the second embodiment at the selected angle) without varying from the selected depth and angle. In some applications, the operator may spray the stone with water from a spray bottle for dust control. This may be done before and/or during grinding.

In the case of the second embodiment, a worker may use a single guide face, as described above, or may vary the angle not only between the first and second guide faces 132 and 142, but also between the moveable guide face 132 and the face of the grinding tool 112. Thereafter, in use, the worker may use the moveable guide face 132 to bevel or chamfer a rectangular (90° in the corner) work piece with the bevel being at an angle other than 45°.

In some cases, the partial housing 14 may be rotationally adjustable. If so, the worker may rotate the partial housing 14 relative to the body of the grinding tool 10. Because the chamfering guide assembly 20 is affixed to the partial housing 14, it also rotates relative to the body of the grinding tool 10. Therefore, by rotating the partial housing 14, the worker can adjust the angle of the chamfering guide assembly 20. This may done to allow the worker to use the chamfer guide assembly 20 in a tight space or for comfort.

Optionally, the worker may use Teflon® tape or a similar coating on the guide faces 32 and 42 during use in order that the faces of the work piece, which are often polished, are not scored or abraded during use of the chamfering tool. Teflon is a registered trademark of E. I. Du Pont De Nemours and Company, 1007 Market Street, Wilmington, Del.

Figure 5:
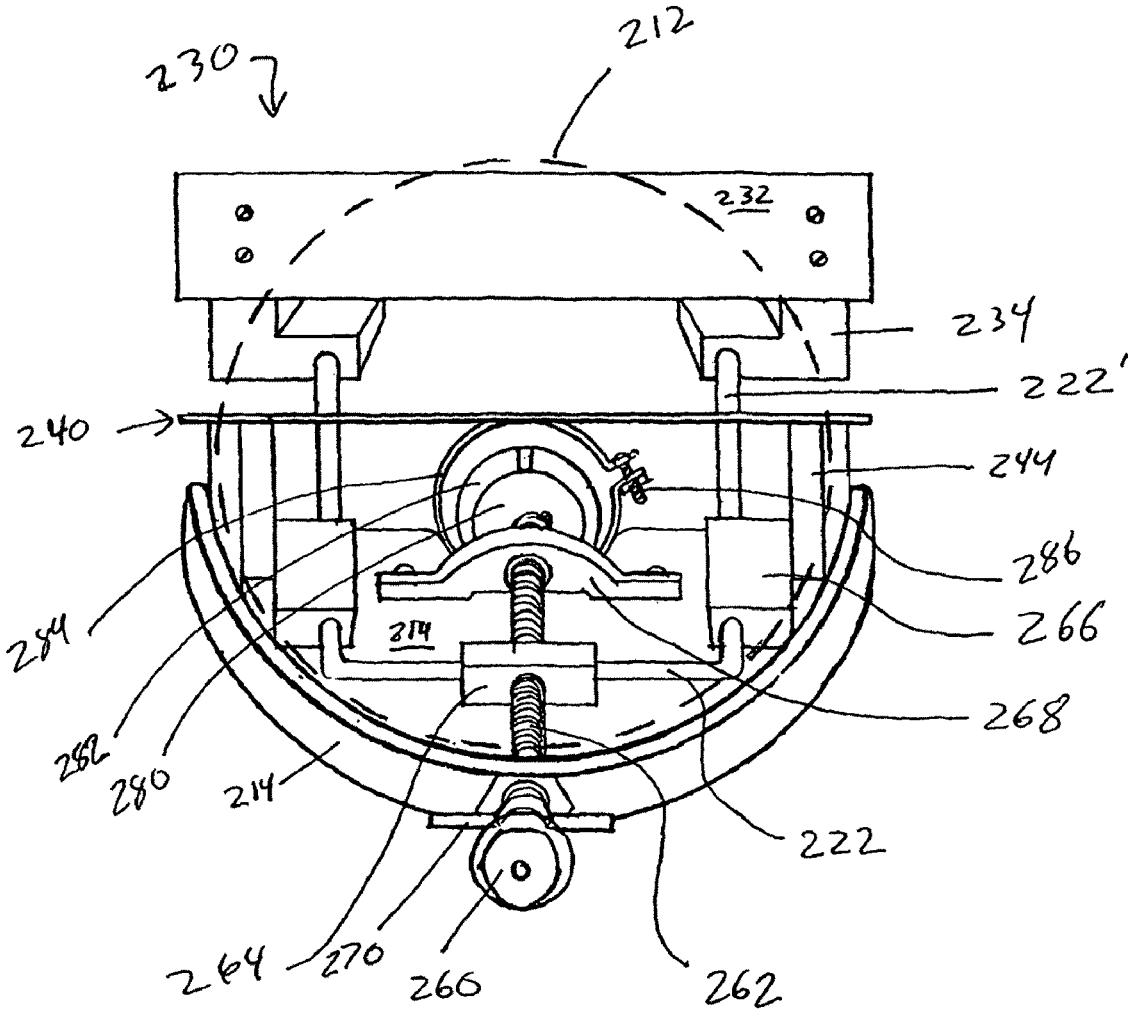
FIG. 5 is a perspective front view of another embodiment.
Figure 6:
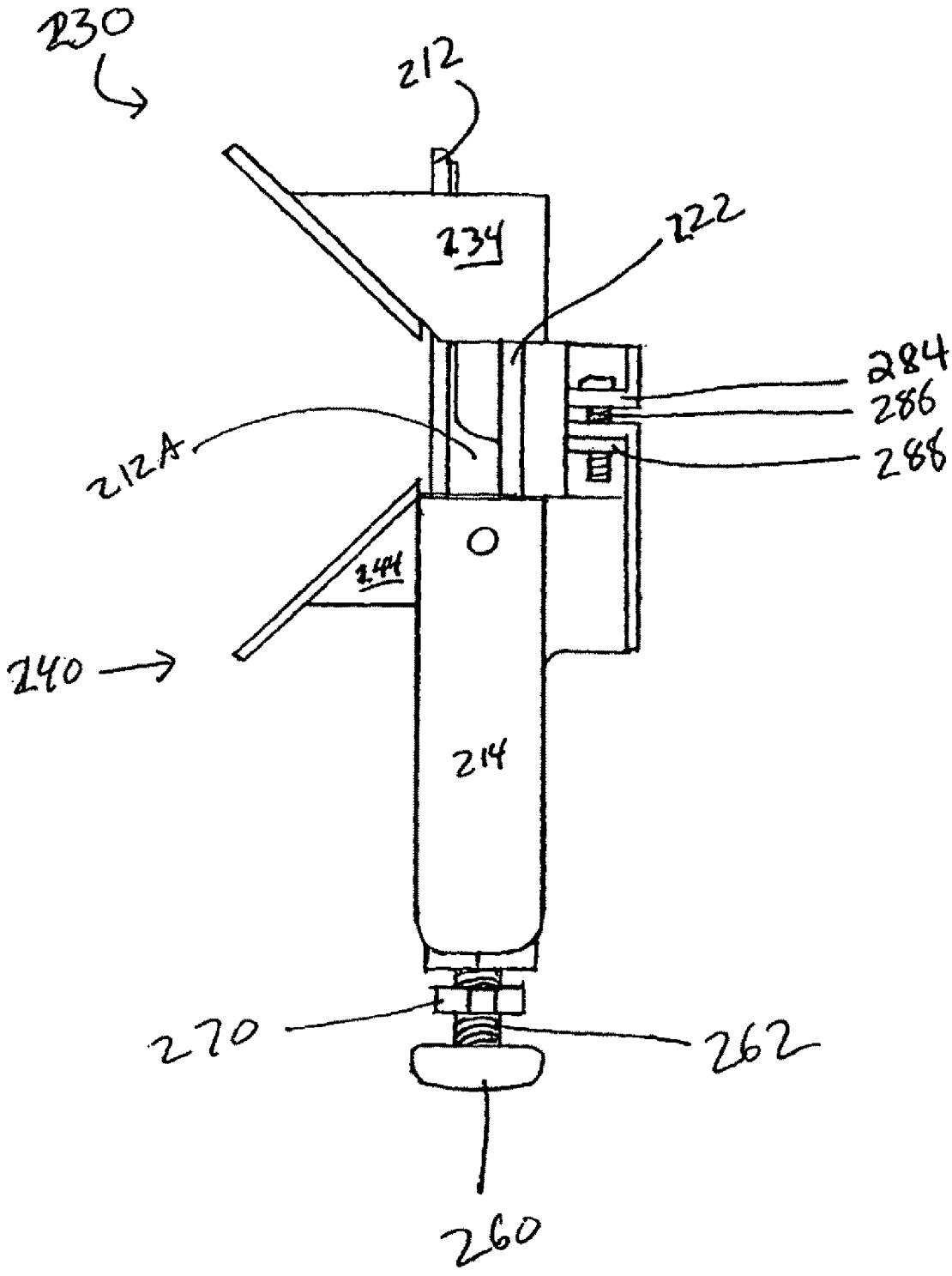
FIG. 6 is a side view of a third embodiment.
Figure 7:
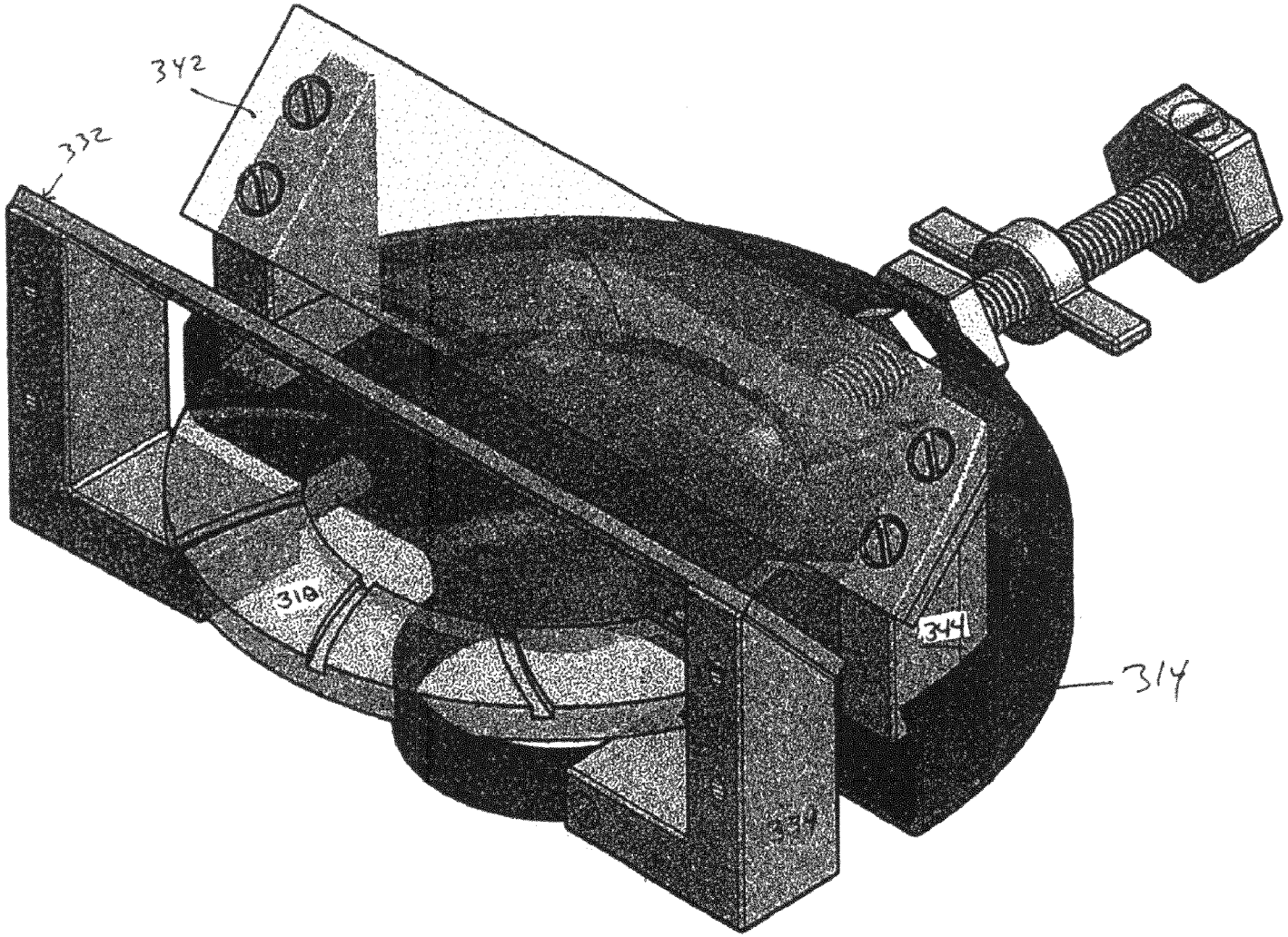
FIG. 7 is a perspective view of another embodiment.
Figure 8:
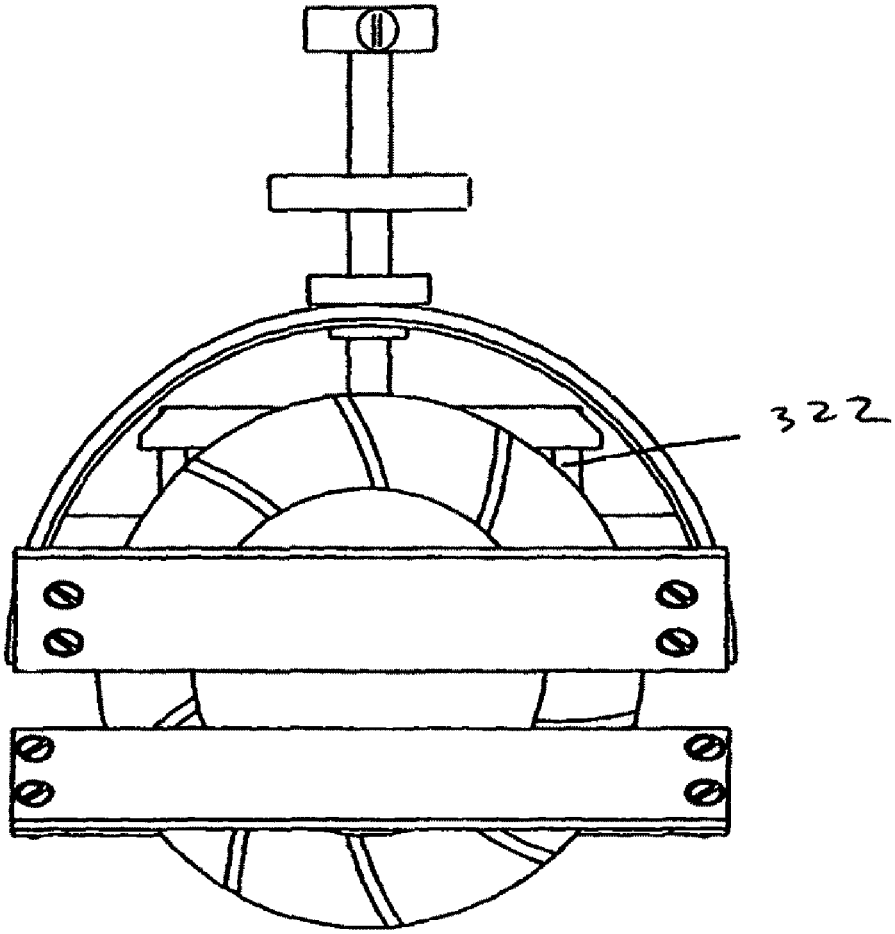
FIG. 8 is a perspective view of a third embodiment.
Figure 9:
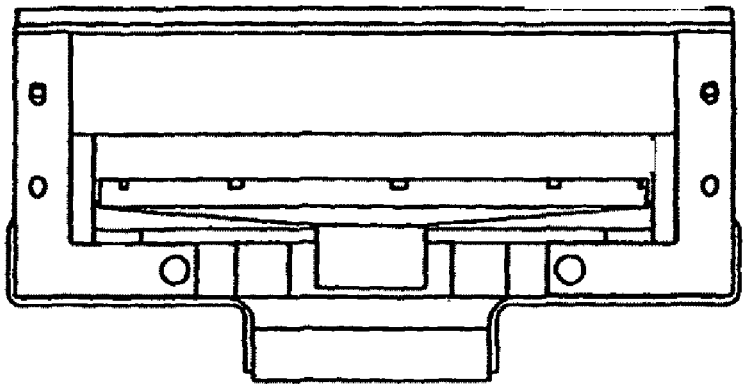
FIG. 9 is a top view.
Figure 10:
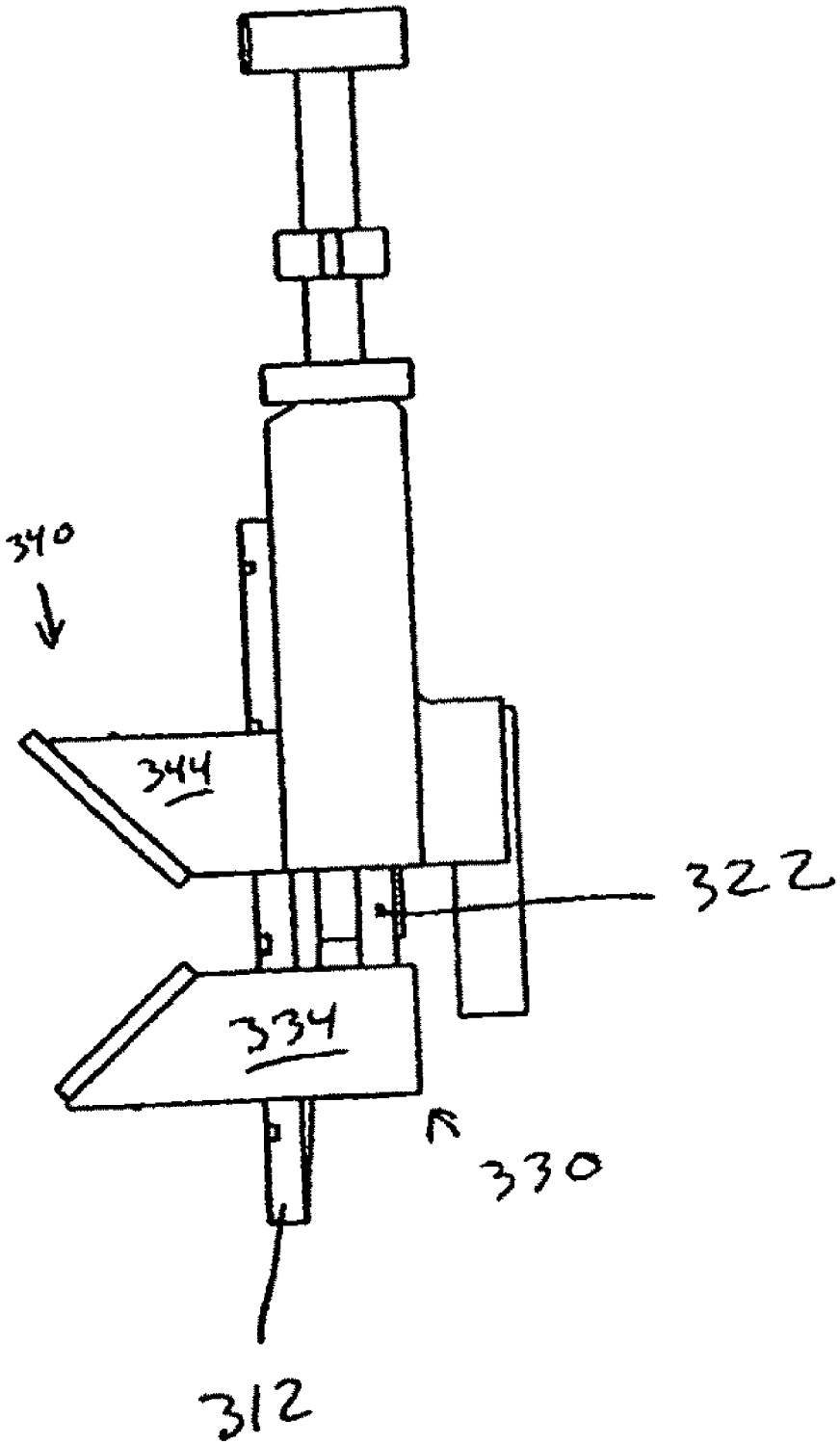
FIG. 10 is a side view.
Figure 11:
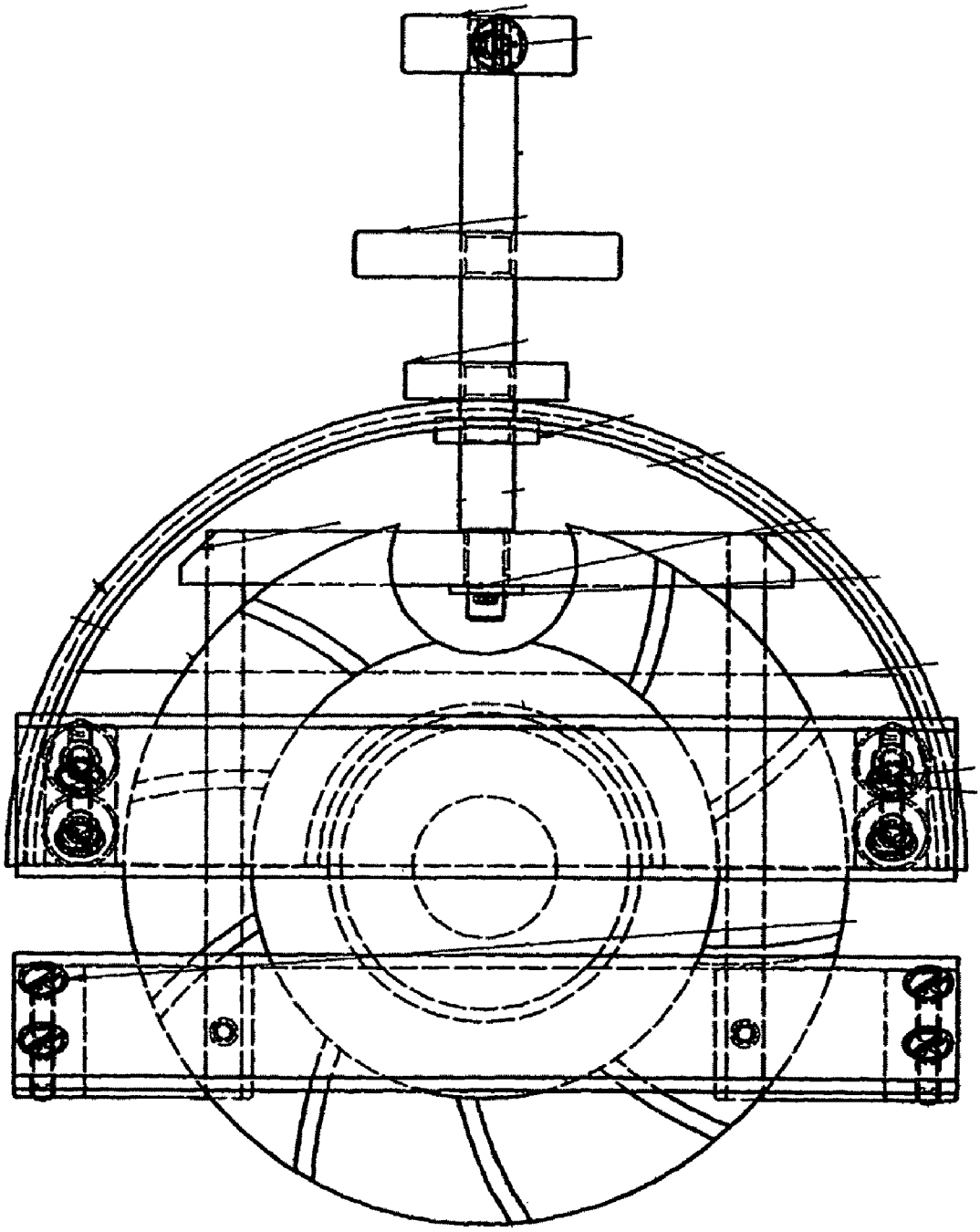
FIG. 11 is a cutaway front view.
Figure 12:
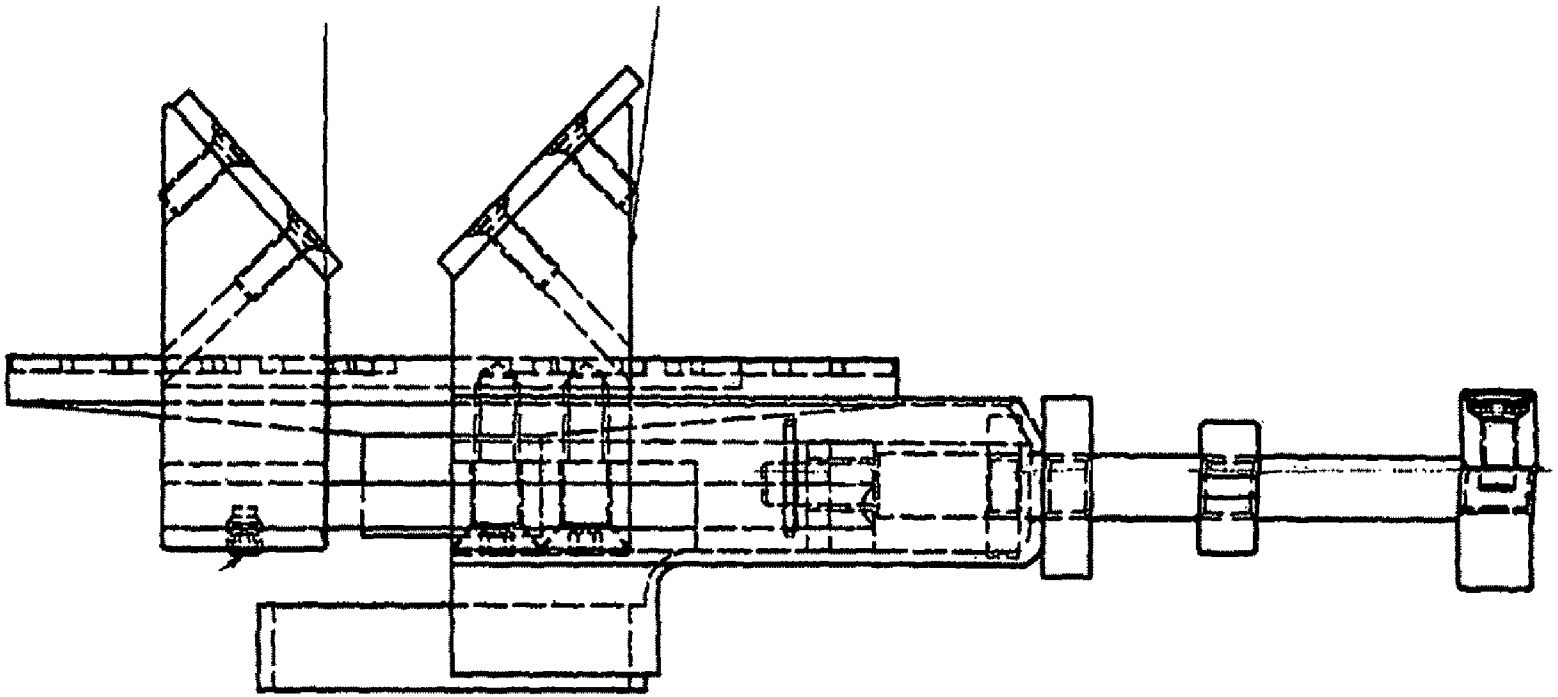
FIG. 12 is a side view with phantom lines showing interior parts.
Figure 13:
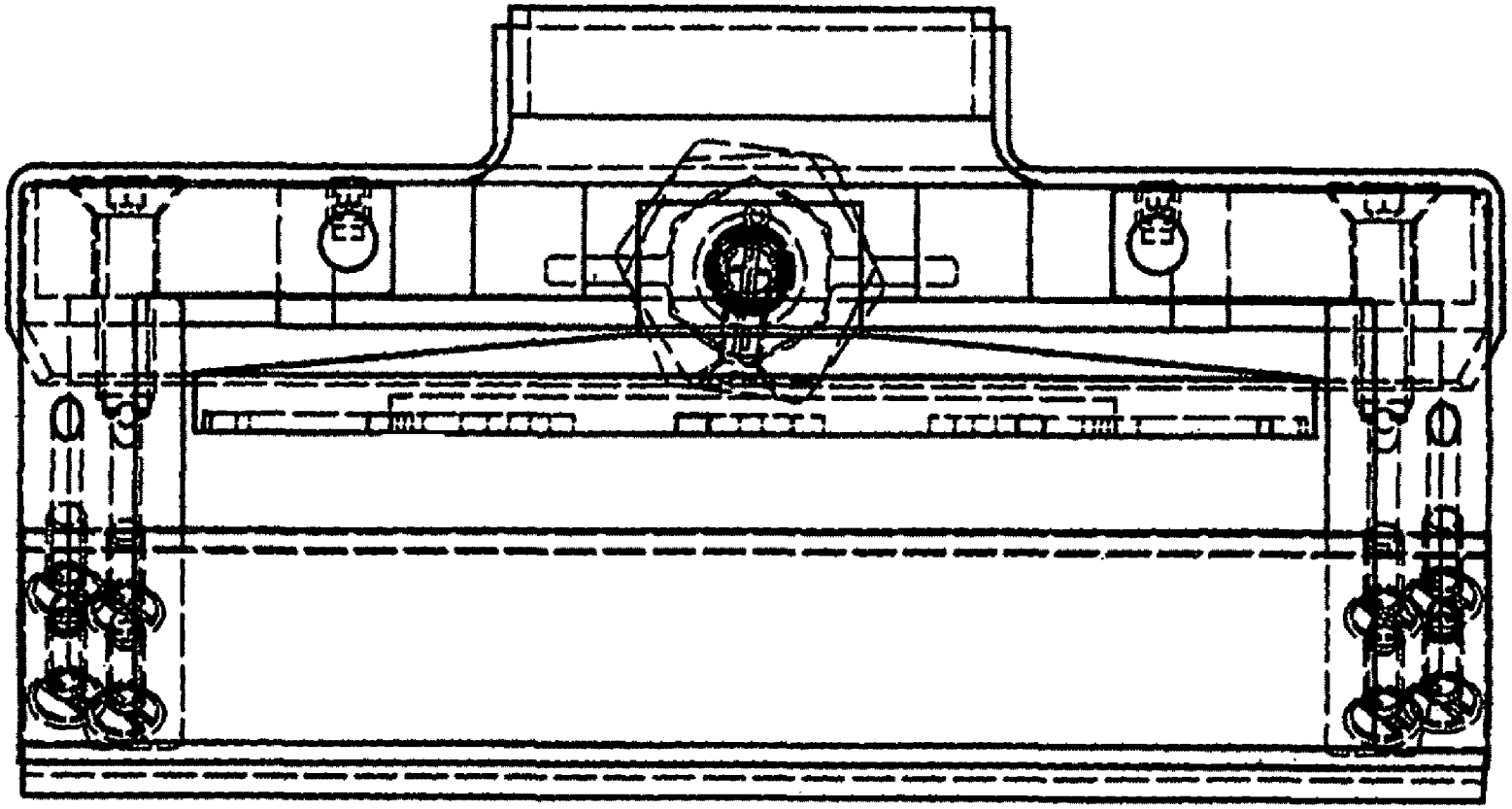
FIG. 13 is a top view with phantom lines showing interior parts.
Figure 14:
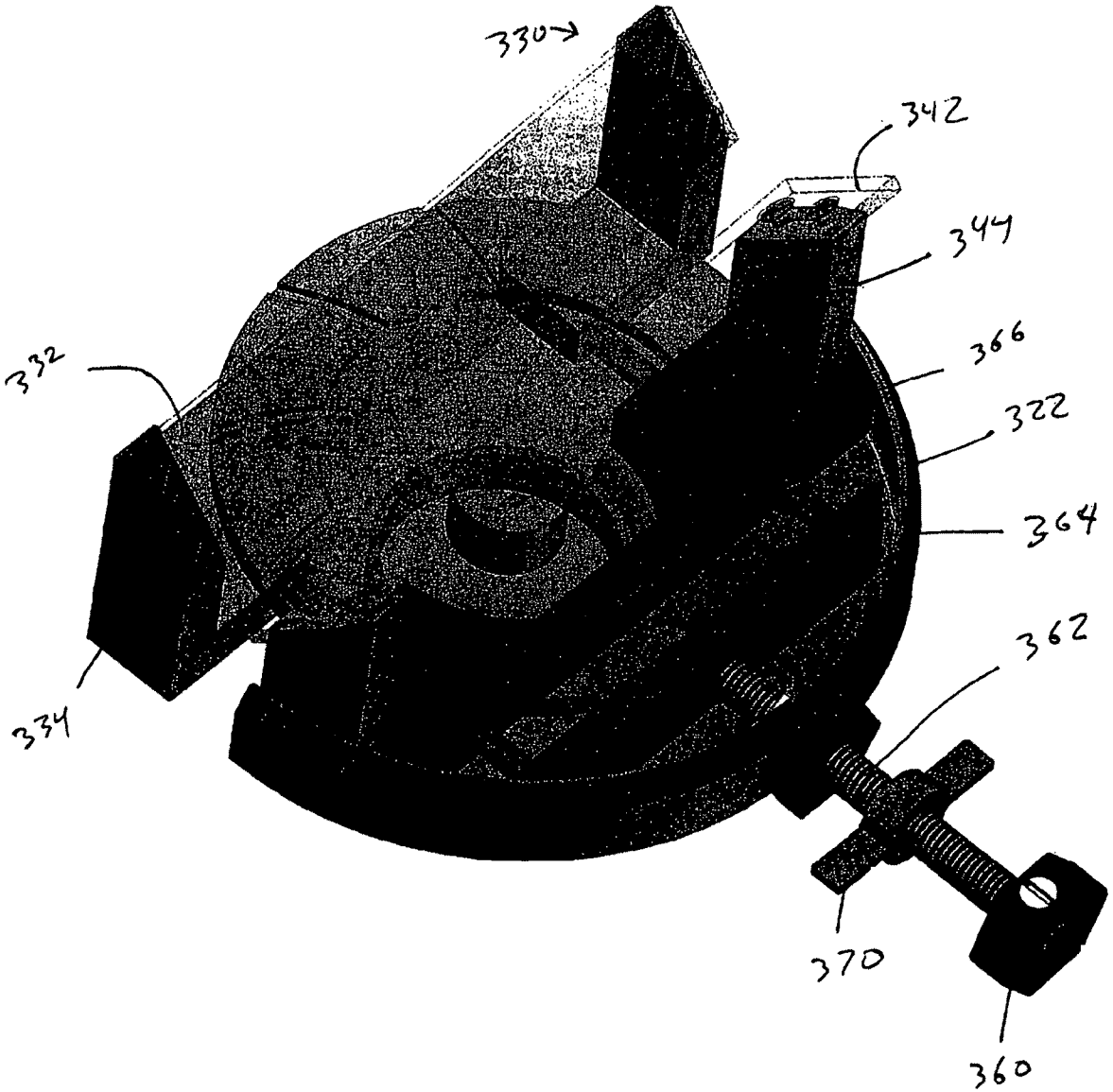
FIG. 14 is another perspective view.

A third embodiment of the chamfering tool has a single screw for adjusting the gap width between the faces. As shown in FIGS. 5 and 6, this embodiment also has a fixed portion 240 and movable portion 230. The movable portion is comprised of two moveable base mounts 234 supporting a movable face 232. The base mounts 234, as before, are attached to adjusting rods 222. The fixed portion 240 is comprised of two base portions 244 and fixed face 242. The base mounts 244 are fixedly attached to the partial housing 214. The grinding disk 212 has been omitted from FIG. 5 to view the components beneath it, with its circumference shown in phantom.

As previously, the adjustment rods 222 slide through a portion of the fixed mounts 244 until a desired position is reached and are then fixed there within a lock screw. In the present embodiment, there is a single lock screw 260. It is fixedly attached to threaded bolt 262 which threads through a hole provided for it in the housing 214 and also through a threaded block 264. Block 264 is fixedly attached to adjusting rod 222. In this embodiment the U-shaped adjusting rod 222 is comprised of a lateral cross member (divided by the block 264) and two leg extensions 222'. At the end of the lateral cross member 222, the adjusting rod is bent and proceeds at right angles through its sliding engagement with the through holes in the base mount guide blocks 266, which are extensions of base mount 244. Thereafter the leg extensions 222' proceed upwards to their fixed attachment to the moveable base mounts 234 on both sides. The threaded bolt 262 then threads through a fixed mount 268, which is fixedly attached to a flat back portion 214' of the housing 214. The fixed mount 268, base mounts 244 and base mount extensions 266 are all fixedly attached to the partial housing 214, 214' through any conventional means including without limitation bolting or welding. Alternatively, they may be integrally formed with the housing 214. The lock screw 260 and threaded bolt 262 include also a locking nut 270 for fixing a selected positions for use after it is adjusted by a user.

For reference in these drawing are components of the grinder and partial housing and grinding disk. These components are not a part of the present invention, but comprise interactive portions of the working environment in which the present invention is typically deployed. These include a grinding wheel to mount 212A, a through hole 280, a mounting disk 282 and a locking collar 284 including a lock screw 286 and lock screw nut 288. The partial housing 214 in some embodiments of the grinding tools in which the invention may be deployed is itself adjustable, with or without the chamfering tool attached. It is adjustable so that it may be rotated to different radial orientations around the grinding disk. This feature is available to accommodate different worker preferences for use of the tool in various positions. The adjustment of the partial housing 214, again with or without chamfering tool in place, is made by removing the grinding disk, loosening the collar lock bolt 286, and nut 288 so that the collar 284 becomes loose enough for the adjusting disk 282 to be moved. The adjusting disk through a series of bosses and detents interactive with the grinder face allows for selective positioning of the partial housing 214 in any of a plurality of positions by corresponding registration of the bosses and detents. After the appropriate selection, the collar 284 is retightened. The grinding disk axle collar 212A is then reinstalled through throughhole 280 and the unit is again ready for operation. As can be seen, the chamfering tool is advantageously designed to avoid interference with the capability of rotationally adjusting the position of the partial housing 214.

As depicted in FIGS. 7-14, a third embodiment includes a moveable portion 330 comprising face mount 334 and a moveable face 332. These components, as before, are arranged and constructed to interoperate with grinding wheel 312. As with the previous version, the preferred embodiment includes a housing 314. As with the second embodiment, the embodiment depicted in FIGS. 7-14 includes the threaded screw 362 driven by a hand turn knob 360 and locked in place with a lock nut 370. It is disposed to thread through housing 314. This assembly is used to adjust the moveable portion 330 and thereby adjust the gap between the guide faces 332 and 342.

In the embodiment depicted in FIGS. 7-14, the threaded screw 362 is affixed to a moving block 364 such that rotation of the threaded shaft 362 by manual operation of turn nut 360 causes translation of block 364 toward and away from the fixed mounting block 344. That is, clockwise rotation of nut 360 will advance lock 364 towards fixed block 366 (fixed block 366 is fixedly attached to the housing 314 and the fixed base mount 344). Fixedly attached to the moving block 364 are the adjusting rods 322. Through holes dimensioned to closely cooperate with adjustment rods 322 are drilled through fixed block 366. Accordingly, translation of moving block 364 towards and away from fixed block 366 moves the moveable portion 330 and adjusts the gaps between the guide faces 332 and 342.

Figure 15:
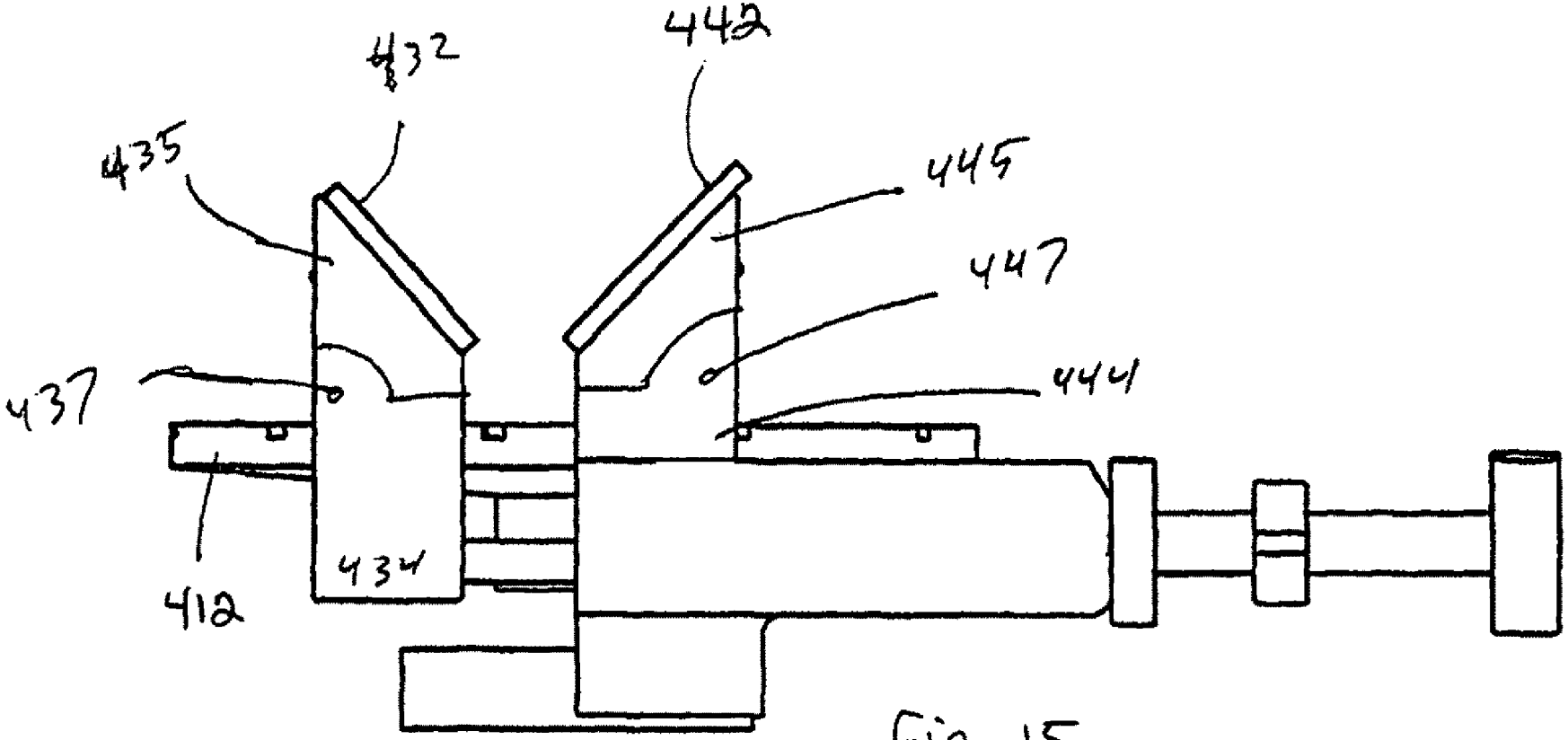
FIG. 15 depicts a fourth embodiment including a hinge feature.
Figure 16:
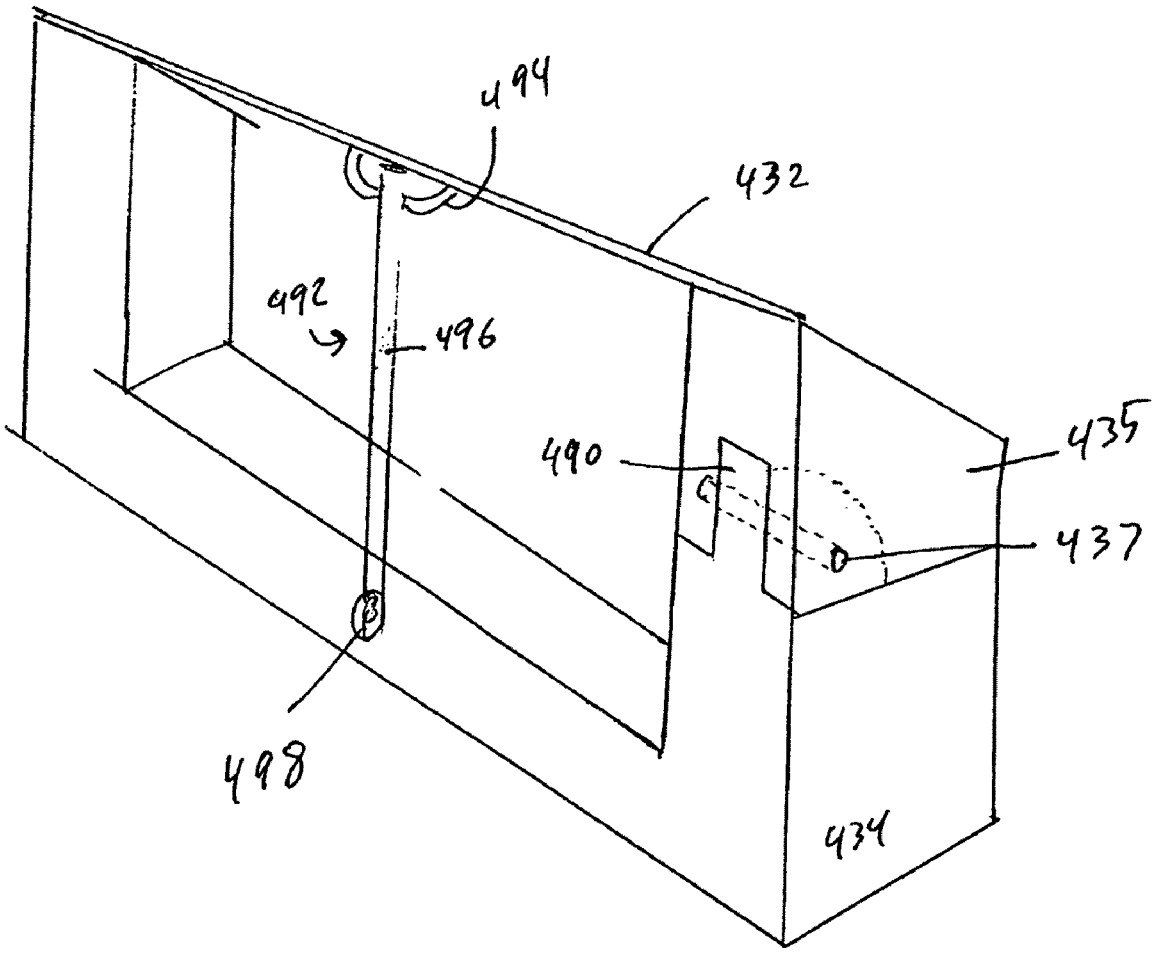
FIG. 16 is a perspective view.

FIGS. 15 and 16 depict a fourth embodiment, including a hinge feature. An advantageous aspect of the embodiment depicted in FIG. 15 is easy access to the grinding wheel 412 for removal and replacement. Replacement of the grinding wheel is part of standard use in order to change coarseness of the grinding surface or to switch from grinding to polishing or buffing functions. Since, the housing is attached securely the grinding tool as a whole, it is as advantageous to change the wheel without disassembling the housing from the grinding tool. Accordingly, the hinged version depicted in FIGS. 15, 16 and 17 accommodates this advantageous use. Mounting block 434 and mounting block 444 include an upper hinged portion 445 and 435 that pivots back from the gap. The pivoting upper mounting bracket portion 435 and 445 hold and support the guide faces 432 and 442. The upper pivoting mounting bracket portions 435 and 445 are attached to the lower base mounts 434 and 444 by hinges 437 and 447. For removal and replacement or adjustment of grinding wheel 412, the upper hinging base mount portions 435 and 445 are pivoted around the hinges 437, 447, thereby providing a wide access gap. The gap may be further widened by adjusting the moveable portion 434 to its farthest extent, thereby also widening the working gap as far as possible.

As depicted in FIG. 16, one hinge configuration would be an extension 490 forged or fabricated into lower block 434. The extension 490 is dimensioned to closely cooperate with a corresponding groove in upper hinging base mount portion 435. Hinge 437 would be a pin extending through both. The extension 490 may be advantageously designed with a convex curvilinear surface through a portion or all of its length, said curvilinear convex surface being dimensioned to closely cooperate and correspond with a curvilinear concave surface in upper hinging mounting base portion 435. A corresponding hinge would be designed on both ends of the base mount 234 and (not depicted) base mount 444.

Also depicted in FIG. 16 is a version of the moveable base mount 434 that is solid through its length traversing across and underneath the surface of the grinding wheel 412 that is not shown in FIG. 15.

Finally, a lock 492 may be advantageously constructed with the hinged embodiment. The lock 492 includes either a screw or hinged engagement with a bracket 494 attached to the guide surface 432. Locking shaft 496 would engage at its upper end with bracket 494 at its lower end, shaft 496 would engage with an adjusting locking nut or thumb screw 498, such that both could be mounted and locked through engagement with and in relation to main block 434.

Figure 17:
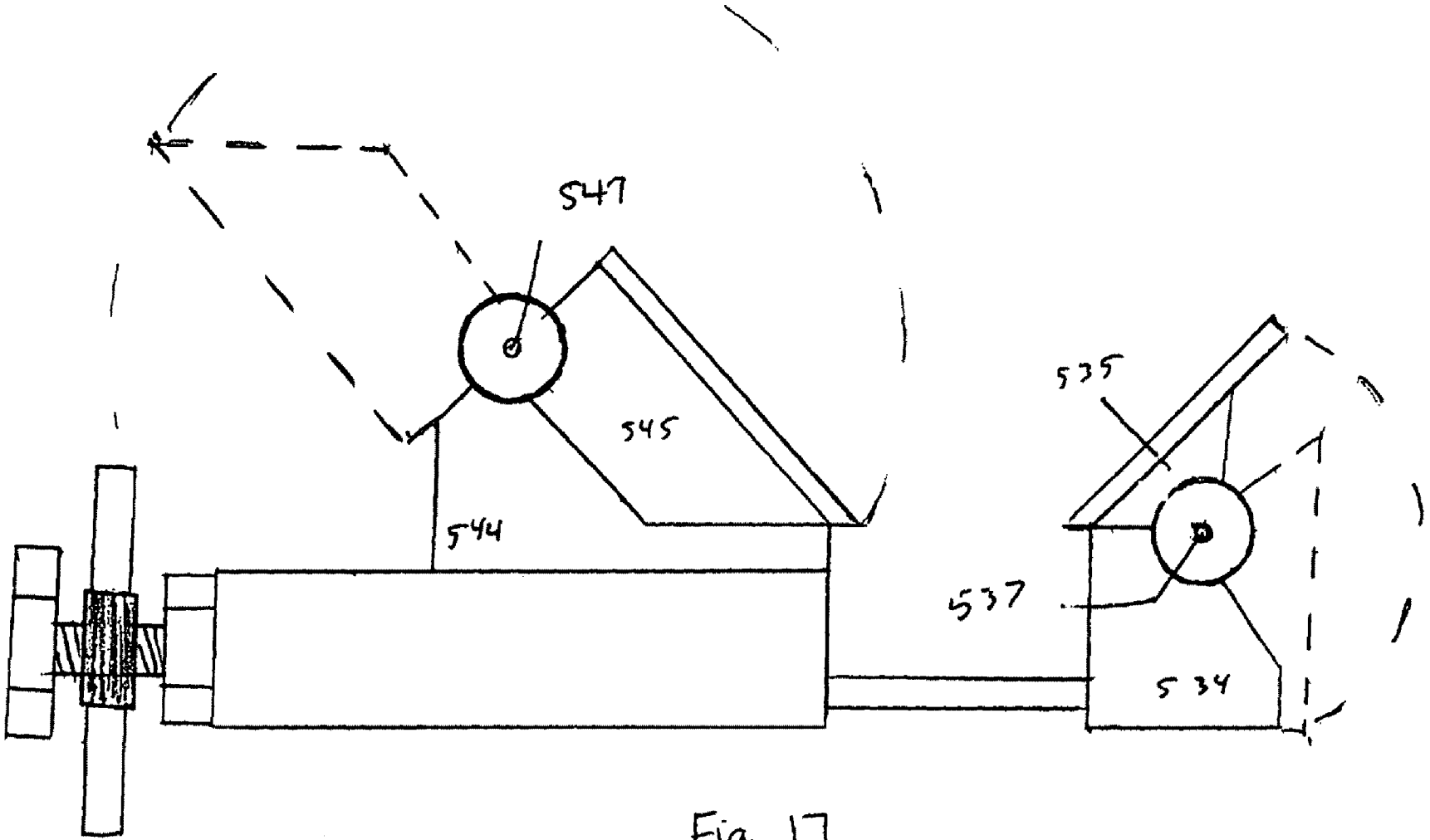
FIG. 17 is a schematic side view of the hinged embodiment.

FIG. 17 is a schematic depiction of another hinged embodiment. The pivoting upper mounting block 545 can rotate around hinge 547 to the removed position shown in phantom above the non-moving fixed portion of the mounting block 544. The moving mounting block 534 includes hinge 537. The rotating portion 535 of the moving mounting block may be rotated from out of its working position to a removed position shown in phantom for maintenance such as replacement of a grinding disk, polishing disk or buffing disk.

In view of the foregoing, it will be seen that the several advantages of the invention are achieved and attained.

The embodiments were chosen and described in order to best explain the principles of the invention and its practical application to thereby enable others skilled in the art to best utilize the invention in various embodiments and with various modifications as are suited to the particular use contemplated.

As various modifications could be made in the constructions and methods herein described and illustrated without departing from the scope of the invention, it is intended that all matter contained in the foregoing description or shown in the accompanying drawings shall be interpreted as illustrative rather than limiting. For example, while in the depicted embodiments the angle between the guide faces is 90°, angles other than 90° may be used. Thus, the breadth and scope of the present invention should not be limited by any of the above-described exemplary embodiments, but should be defined only in accordance with the following claims appended hereto and their equivalents.

What is claimed is:

1. A chamfering tool adapted to mount on a handheld grinder, the grinder having a guard and the grinder having a grinding face, said chamfering tool comprising:

a fixed mount, said fixed mount being adapted to be attached to the handheld grinder;

a moveable mount;

a first work guide face attached to said fixed mount;

a second work guide face attached to said moveable mount;

said first work guide face and said second work guide face defining a space there between, said space being disposed such that the grinding face of the handheld grinder contacts a work piece held against at least one of said first work guide face or said second work guide face;

an adjustment member, said adjustment member being fixed to one of said fixed mount or said moveable mount;

an adjustment member receiver, said adjustment member receiver being on the other of said fixed mount or said moveable mount;

said adjustment member and said adjustment member receiver holding said moveable guide mount in a user selected position and said adjustment member and said adjustment member receiver being adjustable to selectively vary a width of said space between said first guide face and said second guide face; and said width of said space defining a chamfering depth.

2. The chamfering tool of claim 1 further comprising a lock bolt mounted with said adjustment member receiver and disposed to hold said adjustment member in a user selected position.

3. The chamfering tool of claim 1 wherein said guide faces are detachable from said guide face mounts.

4. The chamfering tool of claim 1 wherein said adjustment member is a slide.

5. The chamfering tool of claim 4 wherein said slide has a key.

6. The chamfering tool of claim 1 wherein said guide faces are comprised of stainless steel.

7. The chamfering tool of claim 1 wherein said adjustment member is constructed in a range to vary an angle between said first guide face and said second guide face.

8. The chamfering tool of claim 7 wherein said adjustment member is a curved slide.

9. The chamfering tool of claim 1 wherein said adjusting member is a single U-shaped rod.

10. The chamfering tool of claim 1 comprising a lock bolt, said lock bolt being mounted on a partial housing.

11. The chambering tool of claim 1 further comprising a single lock bolt operative to fix said adjustment member in user selected position.

12. The chamfering tool of claim 1 wherein at least one of said guide faces is removable from a grinding position to a replacement position, said replacement position being adequate to allow an access to the grinding face of the grinding tool for removal and replacement of the grinding face.

13. The chamfering tool of claim 12 further comprising a hinge, said hinge mounting said grinding face to at least one of said grinding faces to at least one of said mounts, such that said grinding face may rotate around said hinge from said grinding position to said replacement position to create said access.

14. The chamfering tool of claim 12 further comprising a locking element, said locking element being disposed to hold at least one of said grinding faces in said grinding position by locking said at least one grinding face in said grinding position relative to said mount.

15. A chamfering tool adapted to mount on a handheld grinder, the grinder having a guard and the grinder having a grinding face, said chamfering tool comprising:

a fixed mount, said fixed mount being adapted to be attached to the handheld grinder;

a moveable mount;

a first work guide face attached to said fixed mount;

a second work guide face attached to said moveable mount;

said first work guide face and said second work guide face defining a space there between, said space being disposed such that the grinding face of the handheld grinder contacts a work piece held against one of said first work guide face and said second work guide face during grinding and such that the other of said first work guide face and said second work guide face substantially prevents grinding beyond a user selected depth of chamfer;

an adjustment member, said adjustment member being fixed to one of said fixed mount or said moveable mount;

an adjustment member receiver, said adjustment member receiver being on the other of said fixed mount or said moveable mount; and said adjustment member and said adjustment member receiver holding said moveable guide mount in a user selected position and said adjustment member and said adjustment member receiver being adjustable to selectively vary a width of said space between said first guide face and said second guide face.

* * * * *